US006076823A

United States Patent [19]

Niezgoda

[11] Patent Number: 6,076,823

[45] Date of Patent: Jun. 20, 2000

[54] TAPERED-EDGE SEPARATOR WEB FOR RECORDING FEEDING

[75] Inventor: Thomas J. Niezgoda, Novi, Mich.

[73] Assignee: Unisys Corporation, Blue Bell, Pa.

[21] Appl. No.: 09/072,738

[22] Filed: May 4, 1998

Related U.S. Application Data

[60] Provisional application No. 60/082,498, Apr. 21, 1998.

[51] Int. Cl.[7] ..... B65H 3/04

[52] U.S. Cl. ..... 271/34; 271/35

[58] Field of Search ..... 271/34, 35, 121, 271/122, 149, 167

[56] References Cited

U.S. PATENT DOCUMENTS 5,074,540 12/1991 Belec et al. ..... 271/34
5,238,236 8/1993 Belec et al. ..... 271/34

FOREIGN PATENT DOCUMENTS 4217618 12/1992 Germany ..... 271/34

*Primary Examiner*—David H. Bollinger
*Attorney, Agent, or Firm*—Rocco L. Adornato; Mark T. Starr; John J. McCormack

[57] ABSTRACT

A separator belt for separating sheets from a stack is provided with symmetrically beveled or tapered edges. Such beveling or tapering eliminates the problem of sheet edges catching on an edge of the separator belt thereby reducing the probability of a misfeed of the sheet.

16 Claims, 4 Drawing Sheets

TAPERED-EDGE SEPARATOR WEB FOR RECORDING FEEDING

This is a Continuation of my Provisional Application C-211PRO 60/082,498, filed Apr. 21, 1998, and claims priority therefrom.

This relates to the high speed feeding of checks or like items and particularly to web means therefor.

BACKGROUND, FEATURES

FIG. 1 shows, schematically and in top view, salient elements of a high speed document feed station (e.g. for rapidly feeding checks etc.), one by one, from an input stack S to be advanced along a track thru a check processing machine. Workers will understand that stack S is placed on a reference platform (or guide-wall W) to present the forward-most document against a feed array (feeder or picker unit F) which thrusts it at high speed down the track path (TP; e.g. along a curved guide wall, etc. At about 150–300 in./sec.).

Various feed mechanisms are contemplated here. Illustrated feeder F entrains a feed belt Fb about (part of a curved) feed wheel F-W (e.g. 3" diam., rotating 600 rpm) with strategically placed idlers I, I' as shown. Two such idlers direct this belt Fb to engage the lower part (e.g. bottom 1–2") of each foremost document in the stack. Where the stack comprises checks (e.g. 6"×3") the checks rest with their short-edge on guide-wall W, usually.

Preferably, the documents in stack S are lightly pressed together, toward feed-belt Fb, by some suitable "pusher", such as the illustrated L-shaped "flag" plate ff, mounted on wall W via a guide-block Fg and urged against stack S by suitable means (e.g. here by guide cable GC pulled by a suitable, adjustable weight WT, and directed by a suitable idler as shown—all as known in the art.)

This feeder array F will be understood as here used with a "separator mechanism" SEP to separate documents as they are fed into the transport track (e.g. to prevent multiple documents being fed together) and to introduce a prescribed inter-document spacing. Here, separator SEP preferably comprises a separator belt $B_s$, entrained by a set of idlers as shown, to "follow" a sector of feedbelt, atop wheel FW, just downstream from where it engages the documents. Belt $B_s$ is driven (e.g. by a suitable drive roller DR, as workers realize) to oppose (resist, at least somewhat) the thrust of feed-belt Fb—either by being driven counter to the direction of Fb (as per arrow in FIG. 1), or by being driven in the same direction, but a bit slower (not shown). Either way, as belt $B_s$ engages a document being advanced by feed-belt Fb, it will tend to seemingly retard its advance—but actually will retard (or reverse) the advance of a "second" "following" document, e.g. if feed-belt Fb feeds two or more together (e.g. a "double", with a second document adhering to the forward-most document via friction, "static cling" etc. whereby this second document would tend to "follow" the feed-advance of the foremost document).

In general, workers will understand that such a belt separator supplies a separator force that opposes the advance force supplied by the feeder belt to thereby prevent more than one document at a time being fed into the transport track. Thus, feeder belt $F_b$ advances the foremost document, while the separator belt restrains any following document from so advancing.

Preferably, a feed-shield FS (FIG. 1) is also provided adjacent the nip (between feed-wheel F-W and separator belt). Shield Fs preferably presents a pair of finger-projections FS-f (see FIG. 4) that deflect document leading edges away from the edge of separator belt (e.g. of square-edge belt B-A in FIG. 4A) to prevent the document from snagging a belt-edge and failing to properly feed.

While other separator arrangements are also contemplated, I, here assume that they all involve such a separator web or belt $B_s$; i.e. a somewhat resilient web constructed for frictional engagement of the so-fed items.

A hitherto vexing problem with such separator belts is that they have seemed to be "speed-limited", so that, as feed-rate increases, they coact with the associated mechanisms to "misbehave" e.g. in such apparatus as FIG. 1 such belts might induce excessive misfeeds, jams, etc. when operated above a certain feed rate (e.g. here, over about 1000 DPM, or documents per minute).

I studied this problem and as a solution; tried "beveling" (tapering) the edges of the separator belt, symmetrically on the side facing the documents—as indicated in FIGS. 2, 3—with a beveling (pref. Angle of about 45°)—where before these edges has been "square" (rectangular or orthogonal i.e. about 90° as per FIGS. 4, 5).

Thus a more conventional separator belt would have "rectangular edges" (see square, 90 degree edges on belt $B_s$ in FIGS. 4, 4A)—contrary-wise, the edges on my Beveled Edge Separator Belt are "tapered"symmetrically out to be thicker as one proceeds inward away from the edges of the belt, as with my preferred belt configuration W-B in FIGS. 2, 3, 5, 5A Such bevel-edges eliminate the problem of leading document-edges catching on an edge of the separator belt. This also allows one to remove the fingers from the feed-shield (e.g. see finger less shield FS' in FIG. 5)—as another feature hereof. And, a "fingerless" shield allows more contact between the document and separator belt.

I also find that my "Beveled Edge Separator Belt" (e.g. as for W-B, FIGS. 5, 5A) makes better, more positive contact with a document than conventional "square edge" separator belts, thereby providing more consistent and reliable document separation. And, it may reduce or eliminate jams caused by document edges being "curled" (e.g. by a square edge belt). At any rate, and to my surprise, I found that merely so tapering the edges of a separator belt would by itself, radically reduce the rate of "misfeeds" and immediately allow me to increase the rate of document feed (e.g. from about 1000 to 1100–1150 DPM) and yet suffer comparatively few misfeeds.

Here, a "misfeed" may be understood as either "nofeed", or a "multiple-feed", or excessive variance inter-document spacing (spacing errors). Here, it should be assumed that other related conditions are properly controlled, such as feed rate, nip pressure with the stack properly "jogged", with proper flag pressure and guide wall orientation (proper nudger belt to flag gap), plus acceptable document condition (e.g. proper material, proper material, dimensions, proper envelope-carriers for torn checks), and with no jams caused by feeder itself, etc.

Thus, it is an object hereof to provide one or more of the foregoing features and advantages. A related object is to do so by providing a separator belt with beveled edges. A related object is to do so also using a finger-less feed-shield.

FIGURES

The foregoing and related features and advantages are contemplated in the following detailed description of embodiments, wherein.

PREFERRED EMBODIMENTS

Figure 1:
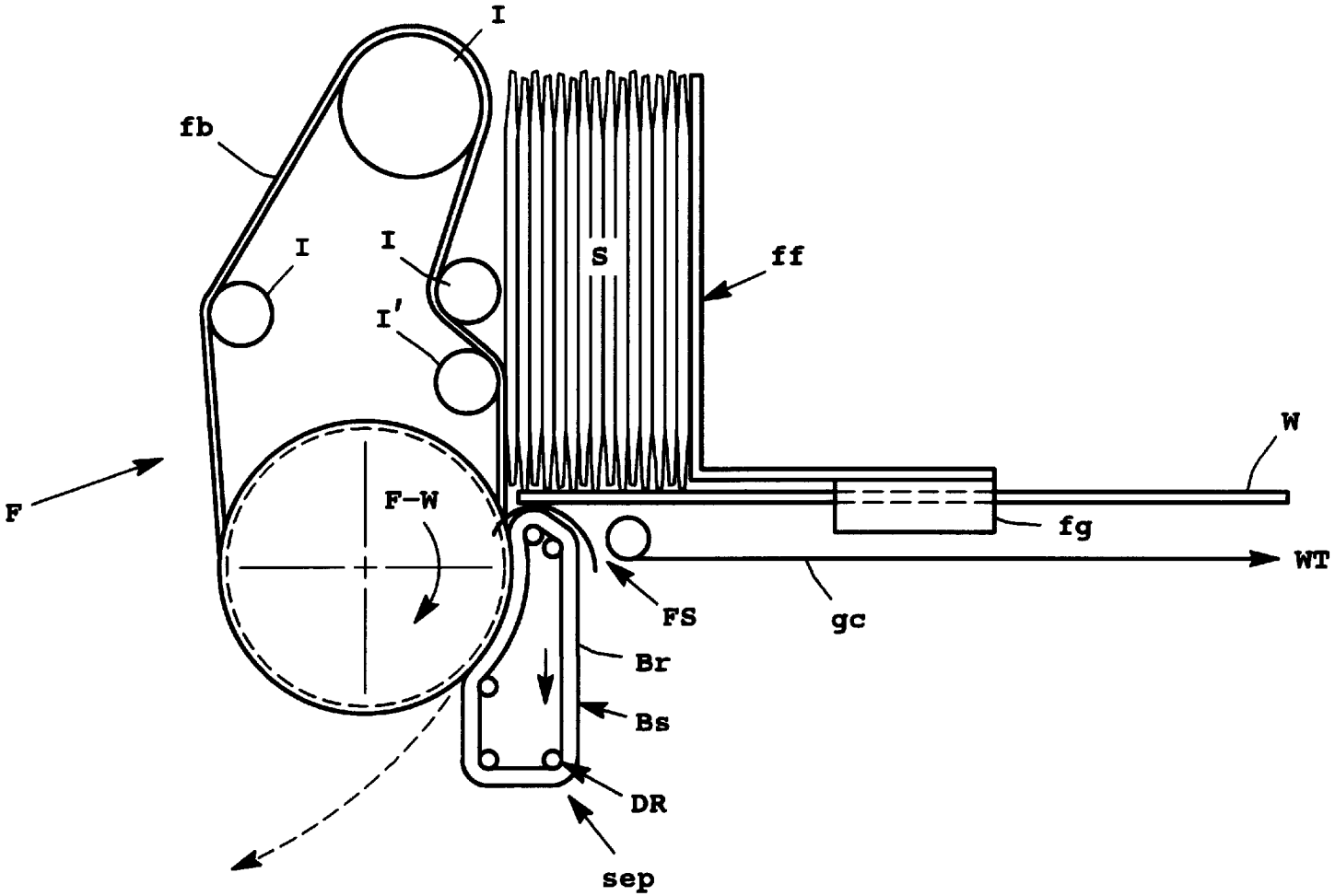
FIG. 1 shows a very schematic side view of a more conventional document feed array; e.g. using a square-edge separator belt shown in FIGS. 6, 4, 4A (with FIG. 4 depicting a fingerered feed-shield)
Figure 2:
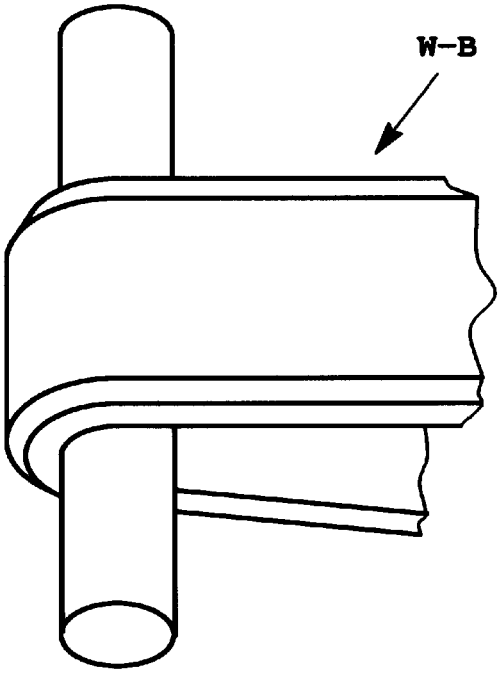
FIG. 2 is a perspective view of the beveled-edge separator belt stretched over a roller.
Figure 3:
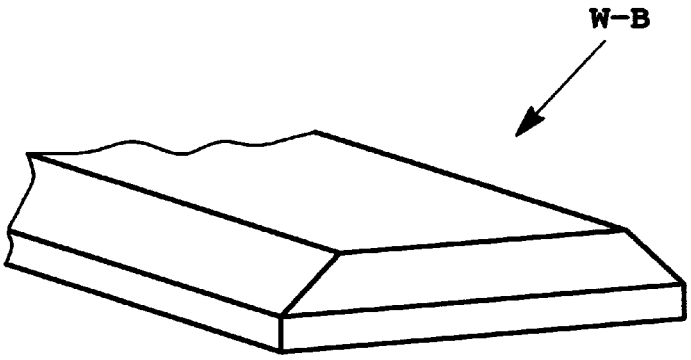
FIG. 3 is a surface profile of a beveled-edge separator belt.
Figure 4:
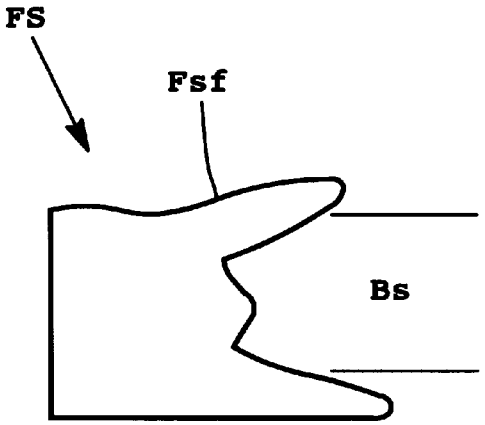
FIG. 4 is a diagram of a fingered feed-shield used in conjunction with a flat-edged separator belt.
Figure 4A:
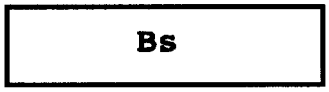
FIG. 4A is a cross-sectional view of the flat edged separator belt shown in FIG. 4.
Figure 5:
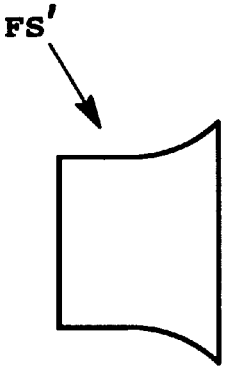
FIG. 5 is a diagram of a fingerless feed-shield used in conjunction with a beveled-edge separator belt.
Figure 5A:
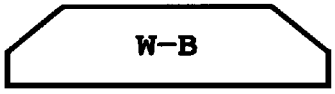
FIG. 5A is a cross-sectional view of the beveled-edge separator belt shown in Fig.
Figure 6:
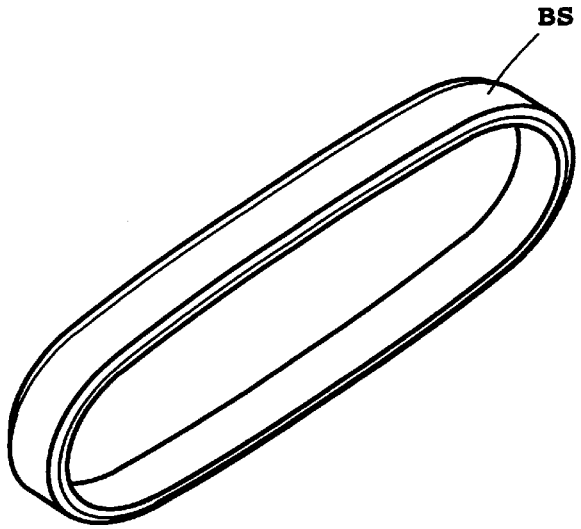
FIG. 6 is a diagram of a square-edged separator belt, illustrating exemplary physical dimensions.
Figure 7:
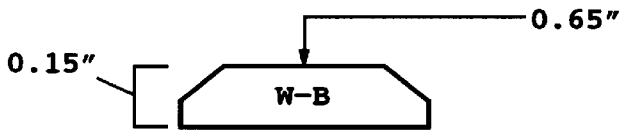
FIG. 7 is a cross-section of a beveled-edged separator belt, illustrating exemplary physical dimensions.

A check processing apparatus (e.g. the Unisys "DP-100" by Unisys Corp.) with a check-feeder unit as in FIG. 1 is assumed equipped with an associated separator unit having a "square-edge" separator belt $B_s$ as in FIG. 4. The feeder is run at 1150 DPM (documents per minute) but is unsatisfactory, giving excess "misfeeds" (e.g. a test run of over 1 million documents at 1150 DPM gave 1 misfeed every 3310 documents). The feeder and separator units may be assumed as conventional, with separator belt $B_s$ being about 1.5–2.5" wide with uniform thickness (e.g. about 0.15", as FIGS. 4, 4A, 6) and with a feed-shield FS having fingers (e.g. as fingers FS-f in FIG. 4).

Some jams occurred evidently from document edges being "curled".

Special test runs were undertaken under essentially the same conditions, except that a "finger-less feed-shield" was used (e.g. as FS' in FIG. 5) and the "square-edge" belt $B_s$ was replaced by a taper belt W-B as in FIGS. 2, 3, 5, 5A, 7. The immediate result was no curling and fewer jams and misfeeds, with better document separation. [No jam complaints].

This new taper-belt gave very satisfactory performance at 1150 DPM, where the prior array (square-edge separator belt) did not. And, at 1100 DPM, only 1 misfeed occurred per about eight thousand tries, with the taper-edged belt (e.g. in a run of about one-half million documents). [Note the Unisys NDP 1000 standard allowed one jam per 12000 and one misfeed per 200 documents]

Taper-edge belt:

To provide a suitable "tape-edged" separator belt, I prefer to modify the square (90° cut) edges of a square-edge belt (e.g. 0.15" thick, 0.85" wide, as per FIGS. 4, 4A) and render both document-facing edges smoothly, symmetrically tapered, e.g. at about 45°, thus reducing belt mid-width from about 0.85" to 0.65" between bevels. (e.g. see FIG. 7).

As opposed to placing the beveling on the "top" side of the separator belt (i.e. facing documents being fed, as in FIGS. 2, 3, 5, 5A and as above described), one may, in certain instances reverse this, placing the bevel on the opposite (bottom) side of the separator belt, away from the documents, though this is not favored.

And, combining the top and bottom bevels above, may, in some instances, be practical, i.e. to bevel both faces on top and both on bottom, but this is less favored.

Figure 8:
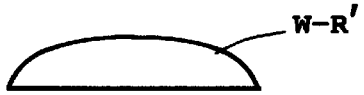
FIG. 8 is a cross-section of a rounded-edged separator belt.

And, rather than using a sharp angled-tape as above, in some cases it may be acceptable to use a smooth, curved taper as in FIG. 8 (this is less favored).

Other Variations:

Making separator belt W-B significantly wider, or thicker or giving it more tension were not found to significantly affect performance.

Performance was degraded somewhat, however, by changing belt-resilience or nip-space (i.e. vs. feed-wheel, FIG. 1).

Methods:

We prefer to render the bevels by grinding; but molding or cutting are acceptable also in most instances.

CONCLUSION

It will be understood that the preferred embodiments described herein are only exemplary, and that the invention is capable of many modifications and variations in construction, arrangement and use without departing from the spirit of the invention. Further modifications of the invention are also possible. For example, the means and methods disclosed herein are also applicable to other separator units, as well as to related systems. Also, the present invention is applicable for enhancing other related feed systems and/or like items.

The above examples of possible variations of the present invention are merely illustrative. Accordingly, the present invention is to be considered as including all possible modifications and variations coming within the scope of the invention as defined by the appended claims.

What is claimed is:

1. A sheet-feeding array wherein sheets are fed singly in a feed direction, from a stack, by moving feed means, with separator means disposed operatively adjacent to delay advance of a following—sheet when a foremost sheet in said stack is fed, said separator means including a separator belt separated from said feed means by a prescribed nip, and wherein said separator belt exhibits one of beveled and rounded edges.

2. The invention of claim 1 wherein said edges are beveled on a side facing the sheet at about 45°.

3. The invention of claim 2 wherein said edges are beveled symmetrically on both edges.

4. The invention of claim 1 wherein a finger-less feed-shield means is also provided adjacent the nip to prevent an edge of a sheet from being snagged by an edge of the separator belt.

5. The invention of claim 4 wherein said separator belt is characterized by curved edges.

6. The invention of claim 5 wherein said edges are symmetrically rounded.

7. The invention of claim 1 wherein said separator belt is beveled at about 45° on each side, across a bevel length of about 0.1".

8. The invention of claim 7 wherein said separator includes bevels, and wherein the bevels are separated by about ½ to one inch.

9. The invention of claim 8 wherein said separator belt is several feet in length and a few 1/10 inch thick, and is resilient.

10. The invention of claim 1 wherein said separator belt has symmertrically-rounded edges.

11. An apparatus for feeding a plurality of sheets from an input stack, the apparatus comprising:

a feeder belt adapted for engaging a first one of the sheets and feeding it from the input stack;

a separator belt disposed adjacent to the feeder belt and adapted to engage a second sheet, the second sheet being disposed after the first sheet in the input stack; and wherein the separator belt includes at least two edges, the edges having one of a round and a tapered configuration.

12. The apparatus of claim 11, further comprising a feed shield having a substantially flat edge, the flat edge disposed in a nip defined between the feed belt and the separator belt.

13. The apparatus of claim 11, wherein the edges of the separator belt are disposed on a side of the separator belt facing the sheets as they are fed from the input stack.

14. A method of feeding a plurality of sheets from an input stack, the method comprising the steps of:

engaging a first sheet in the input stack to feed the first sheet from the input stack with a feed belt;

engaging a second sheet in the input stack adjacent to the first sheet with a separator belt having at least two edges, the edges having one of a rounded and a tapered configuration; and restraining the second sheet relative to the first sheet allowing the first sheet to be fed independently of the second sheet.

15. The method of claim 14, wherein the step of engaging the second sheet includes engaging the second sheet with a side of the separator belt having the one of tapered and rounded edges.

16. The method of claim 14, wherein the step of engaging the second sheet includes engaging the second sheet with at least two edges being tapered an angel of approximately 45°.

* * * * *